US007080991B2

(12) United States Patent
Wang

(10) Patent No.: US 7,080,991 B2
(45) Date of Patent: Jul. 25, 2006

(54) ELECTRICAL CARD CONNECTOR

(75) Inventor: Zhifeng Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,936

(22) Filed: Jun. 27, 2005

(65) Prior Publication Data

US 2006/0128183 A1 Jun. 15, 2006

(30) Foreign Application Priority Data

Dec. 14, 2004 (CN) ..... 2004 2 0054463

(51) Int. Cl.
*H01R 12/00* (2006.01)

(52) U.S. Cl. ..... 439/79; 439/64

(58) Field of Classification Search ..... 439/64, 439/73, 79

See application file for complete search history.

(56) References Cited

U.S. PATENT DOCUMENTS 6,116,919 A * 9/2000 Tung ..... 439/79
6,227,874 B1 * 5/2001 Yu ..... 439/79
6,238,240 B1 * 5/2001 Yu ..... 439/541.5
6,302,710 B1 * 10/2001 Wang et al. ..... 439/79
6,443,742 B1 * 9/2002 Ishikawa ..... 439/79
6,736,656 B1 5/2004 Yu

* cited by examiner

*Primary Examiner*—Briggitte R. Hammond
(74) *Attorney, Agent, or Firm*—Wei Te Chung

(57) ABSTRACT

An electrical card connector (1) includes an insulative header (2) defining a retaining section divided into a front retaining section (25) and a rear retaining section (26) by a longitudinal wall (20), a plurality of contacts (4) being retained in the retaining section and a shielding member (6) covering the retaining section. Each contact (4) comprises a front end (40) extending ahead and into the front retaining section (25) for electrically engaging with an electronic card and a rear end extending backwards and into the rear retaining section (26) and having a horizontal portion (41) and a vertical portion (42). Furthermore, a cover member (5) is provided between the horizontal portions (41) of the contacts (4) and the shielding member (6) and forms a plurality of grooves (51) at a bottom face thereof to secure the horizontal portions (41).

15 Claims, 6 Drawing Sheets

ELECTRICAL CARD CONNECTOR

BACKGROUND OF THE INVENTION

1. Field of the Invention

The present invention generally relates to an electrical card connector, and in particular to an electrical card connector having contacts being protected.

2. Description of Related Art

Electrical card connectors, such as PCMCIA (Personal Computer Memory Card International Association) card connectors, are widely used in computer industry for electrically connecting with inserted electronic cards which function as removable mass storage devices. To meet the trend of miniaturization and high-speed data transmission of computer technology, pitch between contacts of the electrical card connectors is getting smaller whereby the contacts are positioned very close to each other. However, when mounting the electrical card connector on a printed circuit board, once the contacts become deformed, a short circuit may be formed between adjacent contacts resulting in improper signal transmission. An electrical card connector disclosed in U.S. Pat. No. 6,736,656, has a plurality of terminals without any protection, so the terminals may easily become deformed leading to a short circuit.

SUMMARY OF THE INVENTION

Accordingly, an objection of the present invention is to provide an electrical card connector having contacts protected from undesired deformation when mounting the electrical card connector to a printed circuit board.

Another objection of the present invention is to provide an electrical card connector having contacts protected from a short circuit with a shielding member.

In order to achieve the objections set forth, an electrical card connector in accordance with the present invention includes an insulative header defining a retaining section divided into a front retaining section and a rear retaining section by a longitudinal wall, a plurality of contacts being retained in the retaining section and a shielding member covering the retaining section. Each contact comprises a front end extending ahead and into the front retaining section for electrically engaging with an electronic card and a rear end extending backwards and into the rear retaining section and having a horizontal portion and a vertical portion. Furthermore, a cover member is provided between the horizontal portions of the contacts and the shielding member and forms a plurality of grooves at a bottom face thereof to secure the horizontal portions.

Other objects, advantages and novel features of the present invention will become more apparent from the following detailed description of the present embodiment when taken in conjunction with the accompanying drawings.

DETAILED DESCRIPTION OF THE INVENTION

Figure 1:
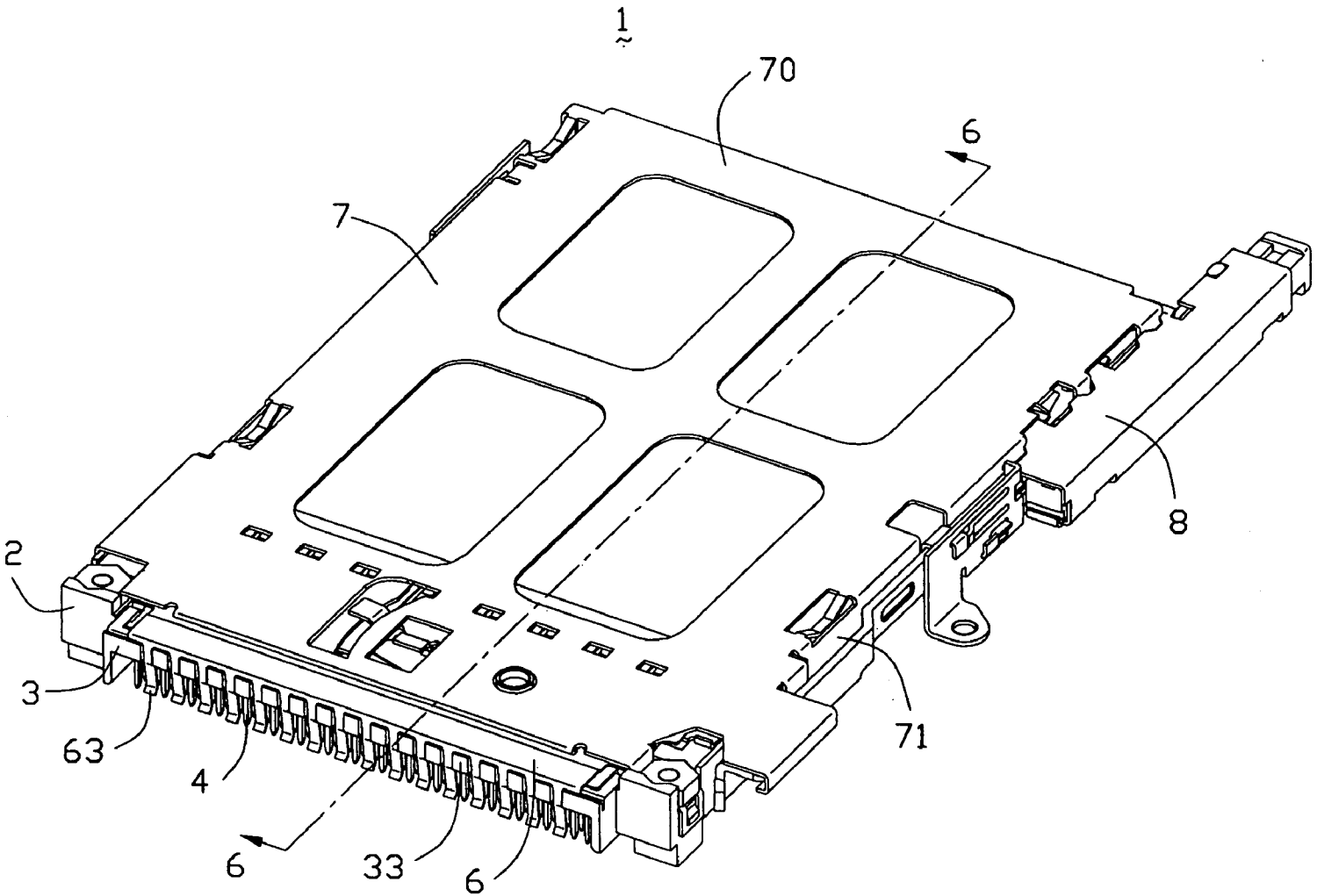
FIG. 1 is a perspective assembled view of an electrical card connector according to the present invention.
Figure 2:
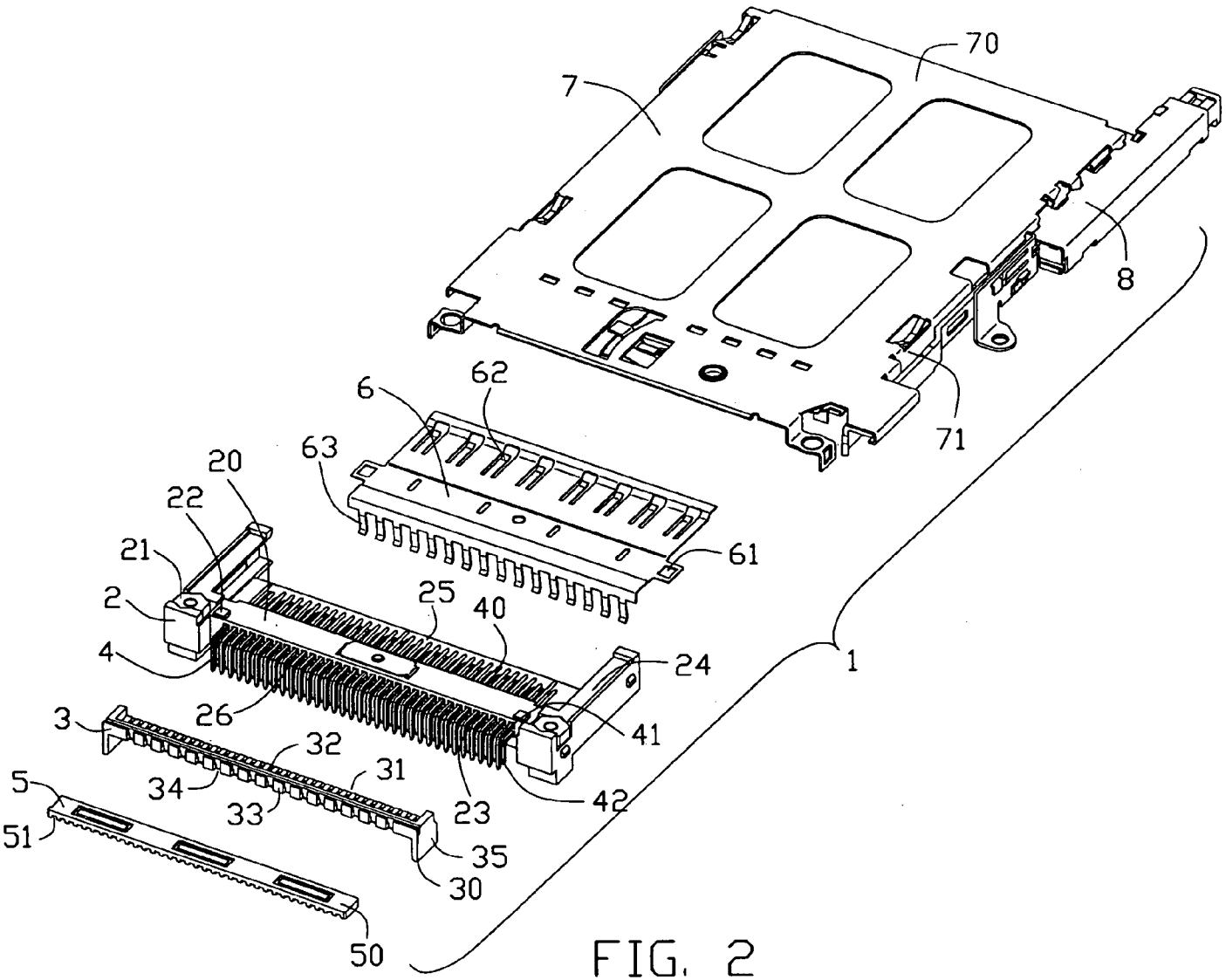
FIG. 2 is a perspective exploded view of the connector.

Referring to the drawings and in particular to FIGS. 1 and 2, an electrical card connector 1 in accordance with the present invention comprises an insulative header 2, a spacer 3, in which a plurality of contacts 4 are provided for electrical connection with an electronic card (not shown) and a printed circuit board (not shown), a cover member 5 covering the contacts 4, a shielding member 6 covering the cover member 5 and the insulative header 2, a shield 7 covering the shielding member 6 and an ejector 8 attached to one side of the shield 7 for ejecting the inserted electronic card therefrom.

The insulative header 2 has two parallel support arms 24 connected by a longitudinal wall 20 formed with a plurality of contact retaining holes 23 in two rows. The two support arms 24 define a retaining section for retaining the contacts 4 arranged in two rows therein being divided into a front retaining section 25 and a rear retaining section 26 by the longitudinal wall 20. The contact 4 is going through the contact retaining hole 23 with a front end 40 extending ahead and into the front retaining section 25 for electrically engaging with the electronic card and a rear end extending backwards and into the rear retaining section 26 and having a horizontal portion 41 and a vertical portion 42. Two bolts 21 are respectively inserted in through holes defined in the support arms 24 for securing the electrical card connector 1 to the printed circuit board.

The spacer 3 has a pair of side walls 35 and a longitudinal wall 30 provided for connecting the pair of side walls 35. In assembly, the spacer 3 is received in the rear retaining section 26 with the pair of side walls 35 abutting against inner surfaces of the support arms 24. The spacer 3 further defines a recess 31 extending ahead from the longitudinal wall 30 and a plurality of projections 33 protruding backwards from and along the longitudinal wall 30 so as to form a notch 34 between every two adjacent projections 33. The height of the projection 33 is bigger than that of the longitudinal wall 30. Furthermore, a plurality of slots 32 arranged along a direction of the longitudinal wall 30 is extending downwardly from a bottom face of the recess 31. In assembly, the vertical portions 42 of the contacts 4 are retained and secured in the slots 32 of the spacer 3, further extending through the slots 32 and downwards to be able to connect to the printed circuit board, simultaneously, the horizontal portions 41 of the contacts 4 are located above the slots 32.

Figure 3:
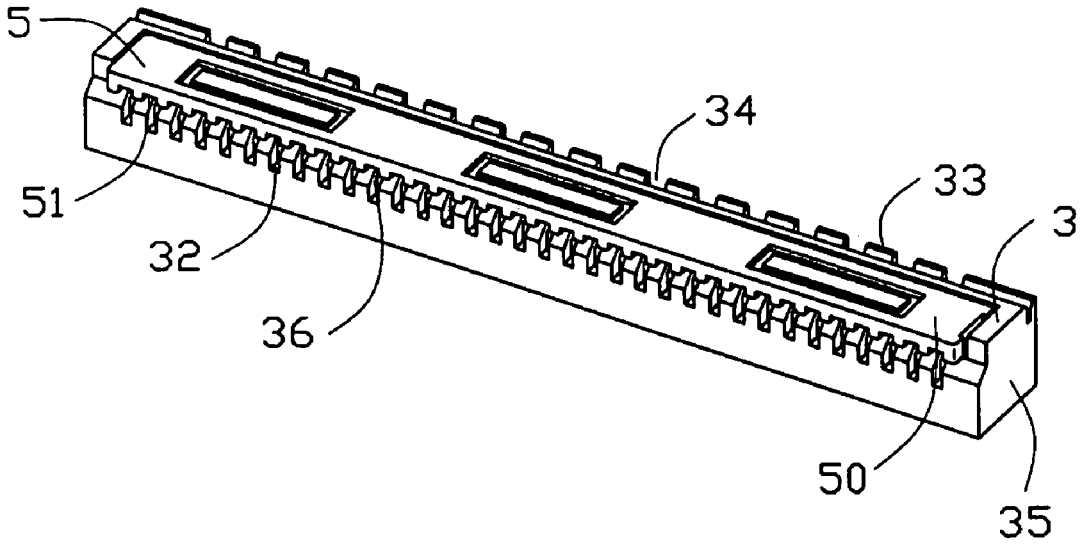
FIG. 3 is a rear view showing a spacer assembled with a cover member.

The cover member 5 is made of plastic, even inferior plastic and has a plurality of grooves 51 at a bottom face thereof. Referring to FIG. 3, when the cover member 5 is assembled into the recess 31 of the spacer 3, the groove 51 and the slot 32 combine to form a passageway 36 for accommodating the horizontal portion 41 of the contact 4. Especially, a top face 50 of the cover member 5 is the same height as the longitudinal wall 30 of the spacer 3.

Figure 4:
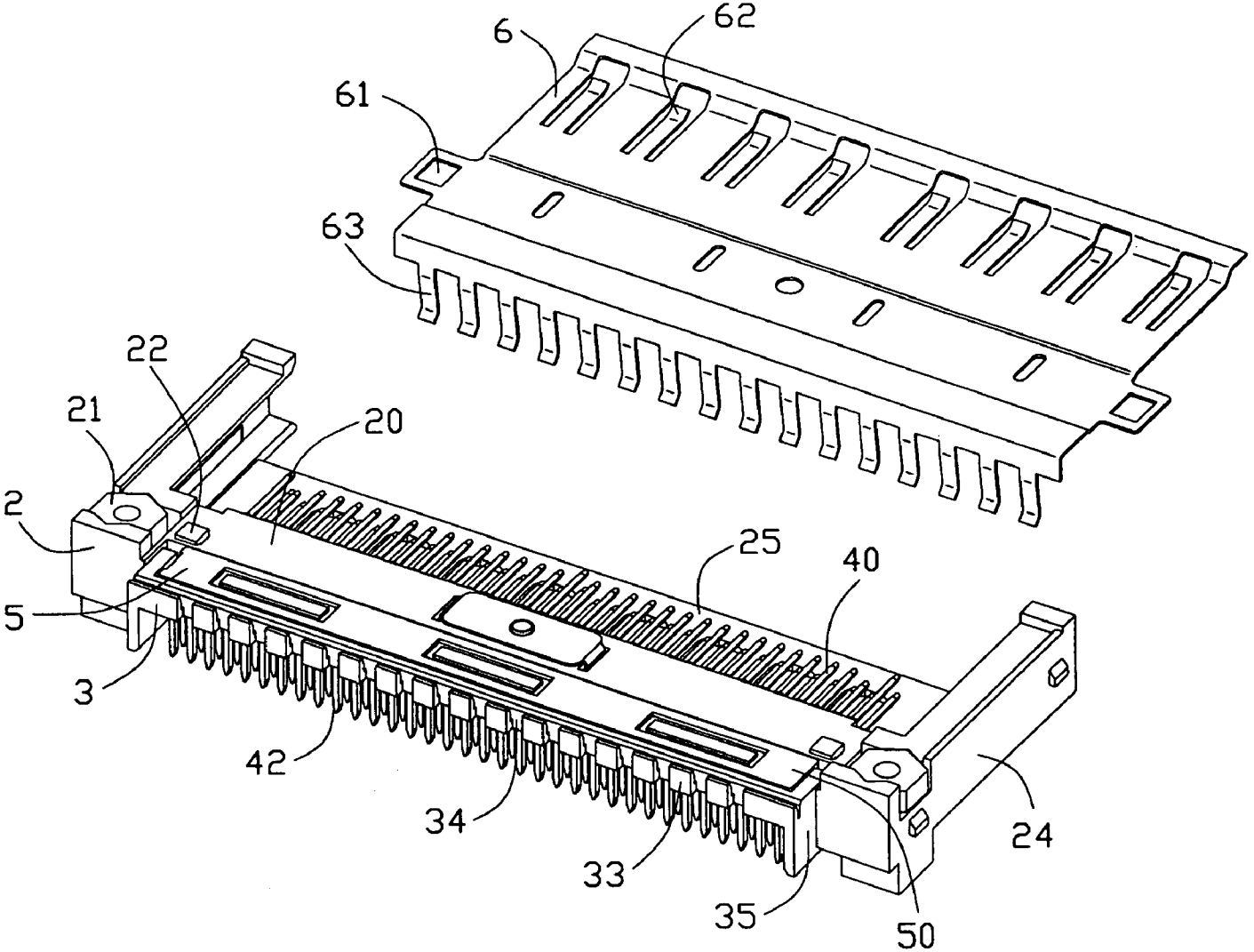
FIG. 4 is a front view showing an insulative header assembled with the spacer and the cover member.
Figure 5:
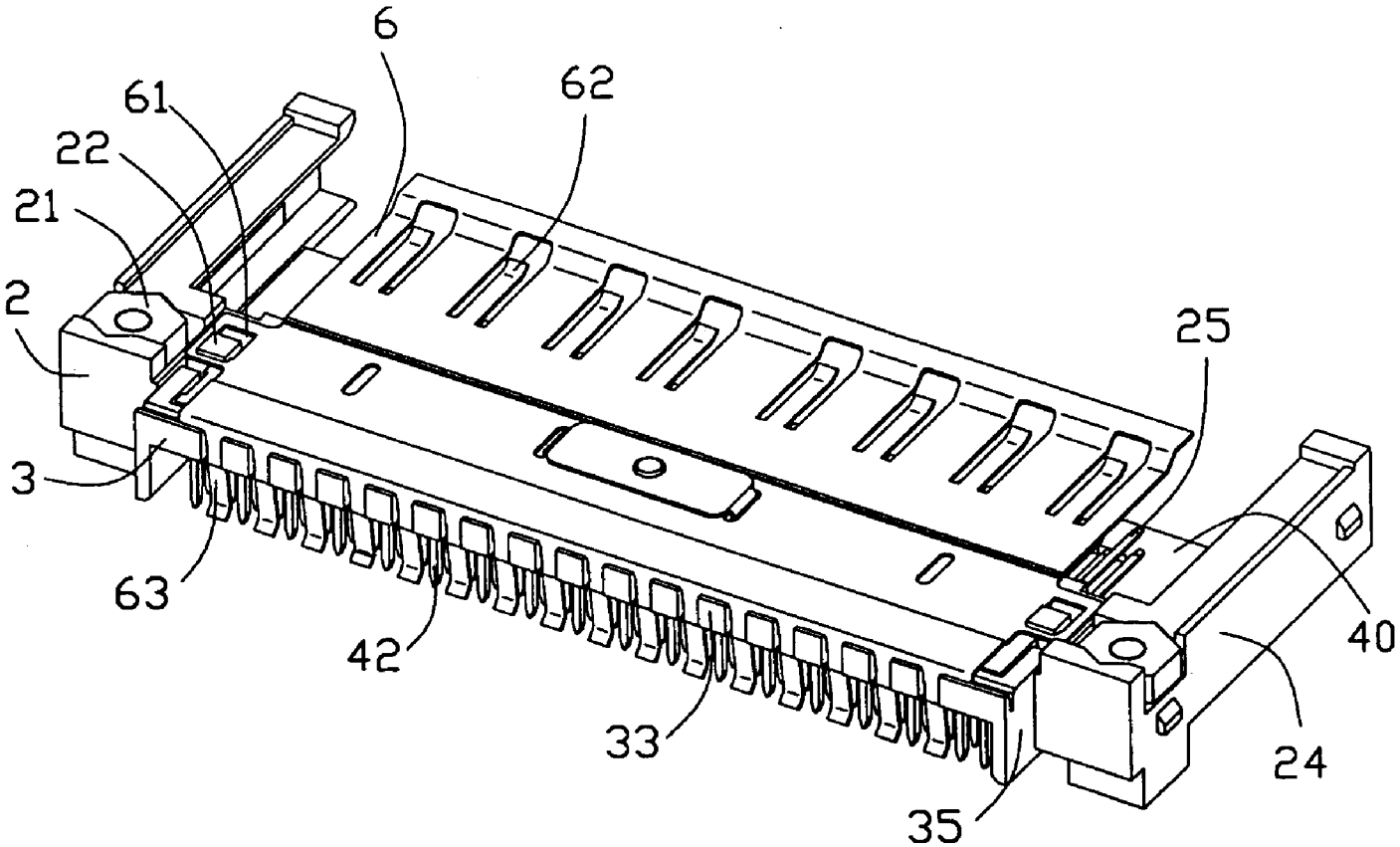
FIG. 5 is a front view showing the insulative header of FIG. 4 assembled with a shielding member.
Figure 6:
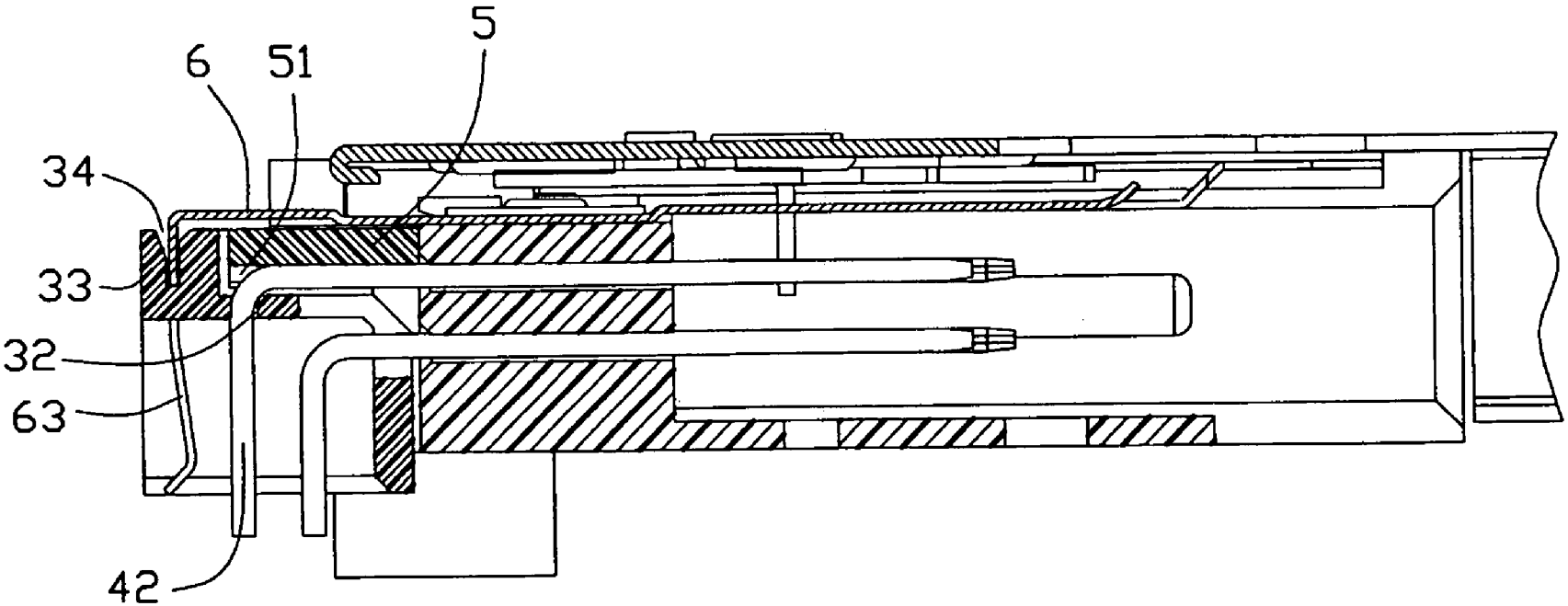
FIG. 6 is a cross-sectional view of a part taken from line 6—6 of FIG. 1.

As shown in FIGS. 4–6, the shielding member 6 covers the retaining section contacting with the top face 50 of the cover member 5 and a top face of the longitudinal wall 20 of the insulative header 2. The shielding member 6 has a metallic body with a right-angled bend, a plurality of board grounding pins 63 extending vertically from a rear longitudinal side of the body and a plurality of card grounding tabs 62 defined at a front longitudinal side of the body for engaging with the electronic card. The shielding member 6 further defines a pair of cutouts 61 at two opposite sides perpendicular to the longitudinal sides for mechanically engaging with a pair of mounting blocks 22 provided at opposite ends of the longitudinal wall 20 so as to fix the shielding member 6 on the insulative header 2. In assembly, the a plurality of board grounding pins 63 are secured in and further extending through the notches 34 of the spacer 3 then downwards to contact the printed circuit board for grounding purposes.

The shield 7 covers on the shielding member 6 and has a plate 70 and a pair of side walls 71 extending downwardly perpendicularly from opposite edges of the plate 70 to form a receiving space (not shown) therebetween for receiving the electronic card therein.

Accordingly, when the electrical card connector 1 is mounted to the printed circuit board, the cover member 5 secures the contacts 4 by the grooves 51 acting on the horizontal portions 41 so as to protect the contacts 4 from adverse affects of external forces, on the other hand, the shielding member 6 covering the contacts 4 with the cover member 5 therebetween further resists the external forces by the board grounding pins 63 being secured in the notches 34 of the spacer 3, as a result, the contacts 4 are protected from becoming deformed. In addition, the cover member 5 made of plastic is able to protect the shielding member 6 from contacting with the contacts 4, further from resulting in a short circuit therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector including:

an insulative header defining a retaining section divided into a front retaining section and a rear retaining section by a longitudinal wall;

a plurality of contacts retained in the retaining section, each contact comprising a front end extending ahead and into the front retaining section for electrically engaging with an electronic card and a rear end extending backwards and into the rear retaining section and having a horizontal portion and a vertical portion extending downwardly from a terminal of the horizontal portion;

a shielding member covering the retaining section of the insulative header; and a cover member provided between the horizontal portions of the contacts and the shielding member and forming a plurality of grooves at a bottom face thereof to secure the horizontal portions; and a spacer with the cover member assembled to and cooperating with the cover member to sandwich the horizontal portions.

2. The electrical card connector as described in claim 1, wherein the cover member is made of inferior plastic.

3. The electrical card connector as described in claim 1, wherein the spacer received in the rear retaining section of the insulative header.

4. The electrical card connector as described in claim 3, wherein the spacer defines a recess extending backwards from a longitudinal wall thereof for receiving the cover member.

5. The electrical card connector as described in claim 4, wherein the recess has a bottom face providing a plurality of slots arranging along a direction of the longitudinal wall of the spacer and extending downwardly, for which the vertical portions of the contacts going through.

6. The electrical card connector as described in claim 5, wherein the groove of the cover member and the slot of the spacer combine to form a passageway for accommodating the horizontal portion of the contact.

7. The electrical card connector as described in claim 3, wherein the spacer has a plurality of projections protruding ahead from and along a longitudinal wall thereof so as to form a notch between every two adjacent projections for securing a board grounding pin of the shielding member.

8. The electrical card connector as described in claim 7, wherein the board grounding pins of the shielding member are extending through the notches and downwards for connecting to a printed circuit board.

9. The electrical card connector as described in claim 3, wherein the spacer has a pair of sidewalls abutting against inner surfaces of the insulative header.

10. The electrical card connector as described in claim 1, wherein the shielding member has a pair of cutouts mechanically engaging with a pair of mounting blocks provided at two opposite ends of the longitudinal wall of the insulative header.

11. An electrical card connector comprising:

an insulative header defining a retaining section, a plurality of contacts retained in the retaining section with front ends extending beyond a first face of the insulative heading for electrically engaging with an electrical card and rear ends extending beyond an opposite second face of the insulative header and forming tail portions extending downwards firm terminals of the rear ends;

a cover member covering and securing the rear ends of the contacts by a plurality of grooves provided at a bottom face thereof; and a shielding member covering the retaining section of the insulative of header with the cover member therebetween.

12. An electrical connector comprising:

an insulative housing defining a front face for confronting an electronic card;

a plurality of contacts disposed in the housing, each of said contacts including a mating portion extending beyond the front face for engagement with the electronic card, and a tail portion extending beyond a rear face of the housing, the tail portion including a horizontal section extending opposite to the mating portion, and a vertical section extending downwardly from the horizontal section, said tail portion being arranged in upper and lower rows;

a spacer upwardly assembled to the housing for alignment of the corresponding tail portion; and a cover member defining a plurality of grooves cooperating with the spacer to sandwich the tail portions in the upper row in a vertical direction.

13. The electrical connector as claimed in claim 12, further including a metallic shield including a horizontal portion vertically covering the cover member, and a vertical portion extending form the horizontal portion to be retainably engaged with the spacer.

14. The electrical card connector as claimed in claim 11, further comprising a spacer assembled to the insulative header, and wherein the cover member is assembled to the spacer.

15. The electrical connector as claimed in claim 12, wherein the cover is assembled to the spacer.

* * * * *